US009844281B2

(12) United States Patent
Fernandez

(10) Patent No.: US 9,844,281 B2
(45) Date of Patent: Dec. 19, 2017

(54) MODULAR STRUCTURE FOR CARDBOARD TOWER-LIKE DISPLAYS

(71) Applicant: Julio Miarnau Fernandez, Barcelona (ES)

(72) Inventor: Julio Miarnau Fernandez, Barcelona (ES)

( * ) Notice: Subject to any disclaimer, the term of this patent is extended or adjusted under 35 U.S.C. 154(b) by 230 days.

(21) Appl. No.: 14/651,751

(22) PCT Filed: Apr. 29, 2014

(86) PCT No.: PCT/ES2014/070376

§ 371 (c)(1),
(2) Date: Jun. 12, 2015

(87) PCT Pub. No.: WO2015/166114

PCT Pub. Date: Nov. 5, 2015

(65) Prior Publication Data

US 2016/0278545 A1 Sep. 29, 2016

(51) Int. Cl.
*A47B 47/00* (2006.01)
*B65D 5/00* (2006.01)
(Continued)

(52) U.S. Cl.
CPC ..... *A47F 5/116* (2013.01); *A47B 45/00* (2013.01); *A47B 47/0008* (2013.01);
(Continued)

(58) Field of Classification Search
CPC ..... A47F 5/114; A47F 5/116; A47F 5/118; Y10S 229/918; B65D 21/0215;
(Continued)

(56) References Cited

U.S. PATENT DOCUMENTS 2,334,985 A * 11/1943 Berry ..... B65D 5/2009 229/167
2,770,410 A * 11/1956 Williamson ..... B65D 5/2009 229/113

(Continued)

FOREIGN PATENT DOCUMENTS

| | | | |
|---|---|---|---|
| DE | 8122356 | U1 | 12/1981 |
| ES | 2281244 | A1 | 9/2007 |
| WO | 2006078478 | A1 | 7/2006 |

OTHER PUBLICATIONS

The International Search Report issued by the Spanish Patent Office(Oficina Española De Patentes Y Marcas) dated Jan. 19, 2015.

*Primary Examiner* — Leslie A Nicholson, III
*Assistant Examiner* — Kimberley S Wright
(74) *Attorney, Agent, or Firm* — Gottlieb, Rackman & Reisman, P.C.

(57) ABSTRACT

The invention relates to a modular structure for a cardboard tower-like display, made up of shelf modules (a) each of which is made up of a cardboard sheet with a four-sided central area (10) whose corners form incoming vertexes (12) and whose sides are folding and flapping lines with respective flaps thereof; together with straight tubes which feature stud modules (b), with the same cross section than the perimeter tubular edges (11) of each shelf module (a), and connecting elements in the shape of corner studs (c), each of which has a central part (30) with arms (31), (32) and (33) projected into three orthogonal spatial directions which fit into the concurrent ends of the tubular edges (11) of each shelf module (a), and the ends corresponding to the tubes which constitute the stud modules (b).

6 Claims, 3 Drawing Sheets

(51) Int. Cl.

| | |
|---|---|
| ***A47F 5/10*** | (2006.01) |
| ***A47F 5/11*** | (2006.01) |
| ***A47B 47/06*** | (2006.01) |
| ***A47F 5/00*** | (2006.01) |
| ***A47B 45/00*** | (2006.01) |
| ***A47B 87/02*** | (2006.01) |

(52) U.S. Cl.
CPC ..... *A47B 47/06* (2013.01); *A47B 87/0246* (2013.01); *A47F 5/0018* (2013.01); *A47F 5/118* (2013.01)

(58) Field of Classification Search
CPC . B65D 5/006; A47B 87/0223; A47B 47/0008; A47B 47/06; A47B 87/0246
See application file for complete search history.

(56) References Cited

U.S. PATENT DOCUMENTS 2,888,147 A * 5/1959 Goldberg ..... A47B 87/0223 108/25
2,893,622 A * 7/1959 Fogel ..... B65D 5/2009 229/162.1
2,961,139 A * 11/1960 Nobili ..... B65D 5/006 206/511
3,650,459 A * 3/1972 Tucker ..... B65D 19/20 206/591
3,831,336 A * 8/1974 Diemer ..... A47B 47/0008 211/186
3,834,324 A * 9/1974 Lang ..... A47B 87/0246 108/190
3,982,682 A * 9/1976 Fremion ..... B65D 5/5033 206/320
4,210,274 A * 7/1980 Leonard ..... B65D 5/006 229/198.1
4,231,299 A * 11/1980 Gebhardt ..... A47F 5/116 108/190
4,236,664 A * 12/1980 Hartelmuller ..... B65D 5/0065 229/117.16
4,341,338 A * 7/1982 Arnold ..... B65D 5/443 229/122.21
4,593,825 A * 6/1986 Hepp ..... A47B 47/06 211/126.12
4,799,620 A * 1/1989 Vilella ..... B65D 5/0065 206/509
D328,535 S * 8/1992 Dupre ..... D6/675
5,433,326 A * 7/1995 Horian ..... A47B 47/00 211/188
5,544,806 A * 8/1996 Anderson ..... B65D 5/2019 206/453
6,378,764 B1 * 4/2002 Teixidor Casanovas ..... B65D 5/0065 206/509
6,513,662 B1 * 2/2003 Stebelton ..... B65D 81/054 206/586
7,066,342 B2 * 6/2006 Baechle ..... B65D 5/006 206/600
7,111,735 B2 * 9/2006 Lowry ..... B65D 5/52 206/586
7,137,517 B2 * 11/2006 Lowry ..... B65D 21/0215 206/586
7,281,648 B2 * 10/2007 Lowry ..... B65D 5/321 206/511
7,546,927 B2 * 6/2009 Lowry ..... A47F 3/142 206/557
7,744,160 B2 * 6/2010 Stolarov ..... A47B 47/0008 108/157.14
8,833,573 B2 * 9/2014 Tomaszewski ..... B65D 19/385 108/186
9,138,079 B2 * 9/2015 Su ..... A47F 5/11
9,185,984 B2 * 11/2015 Henke ..... A47B 47/0008
9,428,298 B2 * 8/2016 Bersamin ..... A47F 5/114
2004/0084514 A1 * 5/2004 Casanovas ..... B65D 5/0045 229/117.07
2005/0046133 A1 * 3/2005 Braucke ..... B25H 3/00 280/47.35
2006/0108408 A1 * 5/2006 Lowry ..... B65D 5/321 229/199
2006/0151410 A1 * 7/2006 Lowry ..... A47F 3/142 211/126.16
2006/0157380 A1 * 7/2006 Lowry ..... B65D 21/0215 206/594
2006/0175227 A1 * 8/2006 Lau ..... B65D 15/22 206/600
2007/0017843 A1 * 1/2007 Keel ..... B65D 5/0025 206/509
2009/0032432 A1 * 2/2009 Kostos ..... B65D 5/006 206/600
2011/0017691 A1 * 1/2011 Wu ..... A47B 47/0008 211/153
2011/0220544 A1 * 9/2011 De Alba ..... B65D 19/385 206/600
2011/0241502 A1 * 10/2011 Kao ..... A47B 47/0008 312/111
2013/0180941 A1 7/2013 Tomaszewski
2015/0008204 A1 * 1/2015 Choy ..... A47B 47/0008 211/186
2015/0122690 A1 * 5/2015 Bersamin ..... A47F 5/114 206/511
2015/0272322 A1 * 10/2015 Wu ..... A47B 47/005 428/99
2015/0330430 A1 * 11/2015 Krieger ..... F16B 12/10 403/286

* cited by examiner

MODULAR STRUCTURE FOR CARDBOARD TOWER-LIKE DISPLAYS

FIELD OF THE INVENTION

This invention relates to a novel modular structure for a cardboard tower-like display, to be used at points of sale. More specifically, the invention relates to a display with a plurality of shelves supported by corner columns.

STATE OF THE ART

Modular cardboard boxes to hold or display products are known in the state of the art. Nevertheless, such boxes arise the technical problem of obtaining modular structures which, apart from being appropriate for handling, storing and transport purposes, also have enough mechanical resistance and stability in order to ensure a suitable product display.

BRIEF DESCRIPTION OF THE INVENTION

It is object of this invention to provide a structure wherein shelves make up modules which may be built from a single die-cut cardboard sheet, forming double supporting walls and projected perimeter edges which are used for assembling, together with hubs. This perimeter edges provide rigidity to the structure and serve as containment for the products displayed therein. The structure includes stud modules which are mounted on the edges through the hubs mentioned above.

By means of the inventive solution provided herein, disassembled modules take up a minimum space and may be easily packaged for storing and transport purposes. At the points of sale, minimum effort and movements are required to assemble or disassemble the display.

For the purposes specified herein, it is proposed a modular structure for cardboard tower-like display, made up of horizontally separated shelves and columns which support such shelves. The main features of this structure comprise:

- Shelves modules, each of which comprises a cardboard sheet having a four-sided central area, wherein the corners form incoming vertexes and the sides are folding lines linked to the respective flaps thereof, which have first sections with consecutive parallel fold lines which are capable of forming projected tubular edges, and second sections which, as a whole, feature a wall with a surface equal to the central area of the sheet and on which it may be overlapped, each flap having reciprocal anchoring elements with such central area of the sheet;
- Straight tubes which comprise stud modules which are part of each column, with the same cross-section than the perimeter tubular edges of each shelf module; and
- Hub-shaped connecting elements, each of which features a central part with arms, projected into three spatial orthogonal directions which fit the concurrent ends of the tubular edges of each shelf module, and the respective ends of the tubes which make up the stud modules.

Other features and advantages of the object of this invention shall be explained in the detailed description hereinbelow:

DESCRIPTION OF DRAWINGS

Taking into account the purposes mentioned above and others related thereto, the invention features the building details and part combination, as it shall be understood on the basis of the description below in relation to the drawings attached hereto, wherein.

Figure 1:
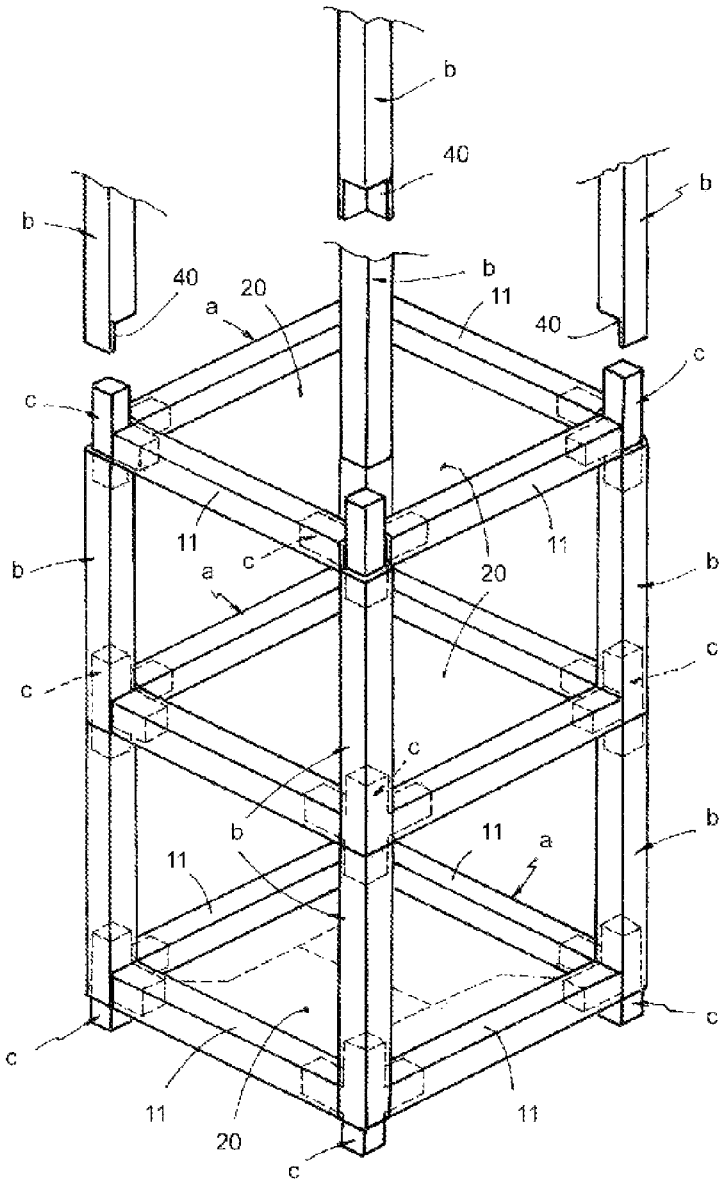
FIG. 1 is a perspective view and projection of a basic example of how to build a merchandise island or tower display made up of shelves, studs and connecting elements, pursuant to this invention.

In such figures, the same reference signs refer to equal or respective parts, pursuant to the numbering described hereinbelow.

LIST OF NUMERICAL REFERENCES (a) Shelf module (b) Corner stud modules (c) Connecting element in the shape of a hub (10) Central four-sided area of the cardboard sheet which makes up every shelf module (a)

(11) Perimeter tubular edges (10)

(12) Incoming straight vertexes of the central area (10).

(13) Fold lines between the central area (10) and first sections (14*a*) of perimeter flaps.

(14*a*) First sections of perimeter flaps (14*b*) Trapezoidal second sections of two opposite perimeter flaps (14*c*) Trapezoidal second sections with rectangular prolongations of two opposite perimeter flaps (15) Fold lines for the first sections (14*a*)

(16) Rectangular flaps with side retention protrusions (17) Slots for flap retentive fitting (16)

(20) False laminar part for covering the top of each shelf module (a)

(30) Central part of the connecting element (c)

(31) Coaxial arms with a distance of (30)

(32) Solidary arm to (30), perpendicular and held in the same virtual plane than arms (31)

(33) False arm perpendicular to arms (31-32)

(34) Arm connection end (33)

(34*a*) Arm fixation pins (34*b*) Connection end side lug (34)

(34*c*) Straight side nerve with a widened end of end (34)

(35) Fitting cavity of end (34) of arm (33)

(36) Lug fitting holes (34*a*)

(37) Side hole of (30) for (34*b*) fitting (38) Side wall slot (30) congruent with nerve (34*c*)

(40) Module gapped end (b)

DETAILED DESCRIPTION OF THE INVENTION

The structure for the tower-like display is made up of shelf modules (a), stud modules (b) to build corner columns and connecting elements (c) in the shape of hubs which connect such shelf modules (a) and stud modules (b).

Figure 2:
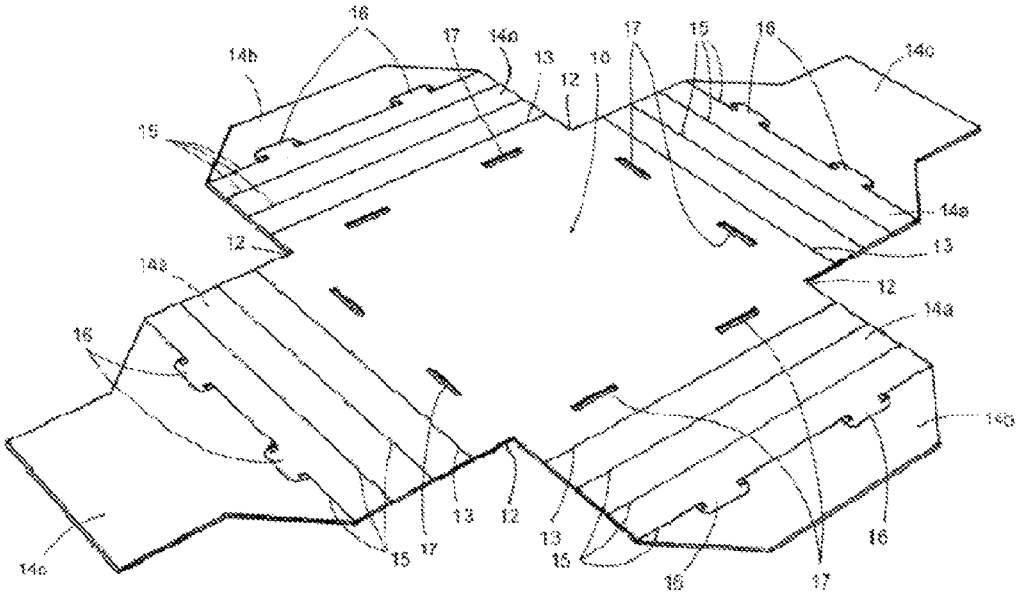
FIG. 2 is a perspective view of the die-cut cardboard sheet which comprises each shelf.

Each shelf module (a) is built from a die-cut cardboard sheet, as shown in FIG. 2.

Upon building thereof, each sheet allows obtaining one shelf (a) which has a double reinforced main wall in the shape of a quadrilateral, with a perimeter tubular edge (11) for containment purposes and corners which form incoming straight angles (12) holding the respective connective elements (c).

The sheet features a four-sided central area (10) whose corners form incoming straight vertexes (12) and whose sides are fold lines (13) connecting the respective flaps, which have first sections (14*a*) with consecutive parallel fold lines (15) and second sections (14*b*-14*c*) which, as a whole, make up a wall with a surface equal to the central area (10) of the sheet, and which can be overlapped.

In the four flaps, the first sections thereof (14*a*) and the respective fold lines (15) make up the containment perimeter edges (11) of the shelf. These first sections (14*a*) include assembling and anchoring means with the central area (10) of the sheet.

For that purpose, the rectangular flaps (16) featuring a pair of side containment protrusions are built from the respective "U" shaped dies, with fold lines (15) between the first (14*a*) and the second (14*b*-14*c*) sections of each flap. The flaps (16) fit retentively in the respective straight slots (17) which are formed in the central area (10) of the sheet, which coincides with the virtual line defining the border of such central area (10).

The second sections (14*b*) from two opposite flaps have a trapezoidal shape and the second sections (14*c*) of the two remaining flaps also feature rectangular prolongations to make up, in all, a surface which is equal to the part of the central area (10).

When built this way, the shelf supporting wall is double, being formed by the wall (10) and portions of terminal flaps (14*b*) and (14*c*), and being able to overlap a third false wall made up of a cardboard sheet (20) which reinforces the shelf and which may contain the appropriate artwork, providing the shelf with an aesthetic cover.

Stud modules (b) feature straight tubes of equal length and a cross section which is equal to the section of the tubular edges (11) of each shelf (a), being the section in the example herein a square. Each tube (b) may be obtained by folding and sticking a cardboard die-cut rectangular sheet.

The connecting elements are corner hubs to structurally link each shelf module (a) with the studs (b), comprising a central part (30) and arms (31), (32) and (33) projected into three orthogonal spatial axes.

The afored mentioned arms (31), (32) and (33) feature a square cross section for cooperative fitting purposes in the corresponding ends of the tubular edges (11) of shelf modules (a) and studs (b).

Preferably, in order to reduce packing space, each connecting element module (c) in the shape of corner hub includes a central area (30) with three arms comprised in the same virtual plane, wherein two arms (31) are coaxial with each other and a third arm (32) is perpendicular to such arms (31), in a "T" letter shape. Then, each connecting element (c) features a fourth arm (33) with a perpendicular axis to such virtual plane, which counts with and end with fixation means which are reciprocal to the central area (30).

Arm (33) has an end (34) which retentively fits into a cavity which is congruent (35) to the central area (30).

Figure 5:
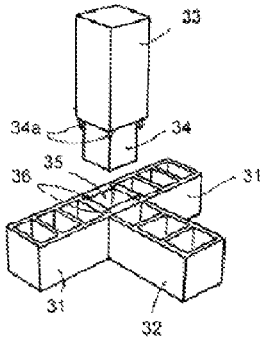
FIGS. 5 to 7 are perspective and exploded views of a connecting element, showing three modalities for fixing the parts which are part thereof.

Upon building thereof (FIG. 5), the arm end (34) features pins (34*a*) which fit into the respective orifices (36) of the edges of the cavity (35).

Figure 6:
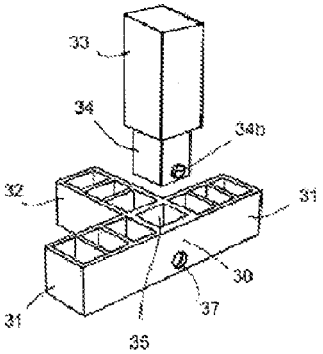

In another variation (FIG. 6), such arm end (34) features a side lug (34*b*) which retentively fits into a side orifice (37) in the wall of the central area (30).

Figure 7:
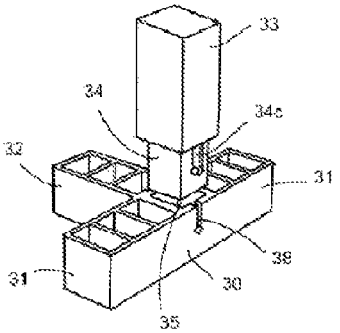

Pursuant to another variation (FIG. 7), the arm end (34) counts with a side straight nerve (34*c*) with a widened end which fits retentively into a side slot (38) which is congruent to the wall of the central area (30).

Each stud (b) counts with a gap (40) in one of its ends with a height equal to the height of the central area (30) of each piece-hub (c), therefore, in mounting position (FIG. 1), the part of the ungapped wall covers the above mentioned central area (30) of the corresponding hub-element.

Figure 3:
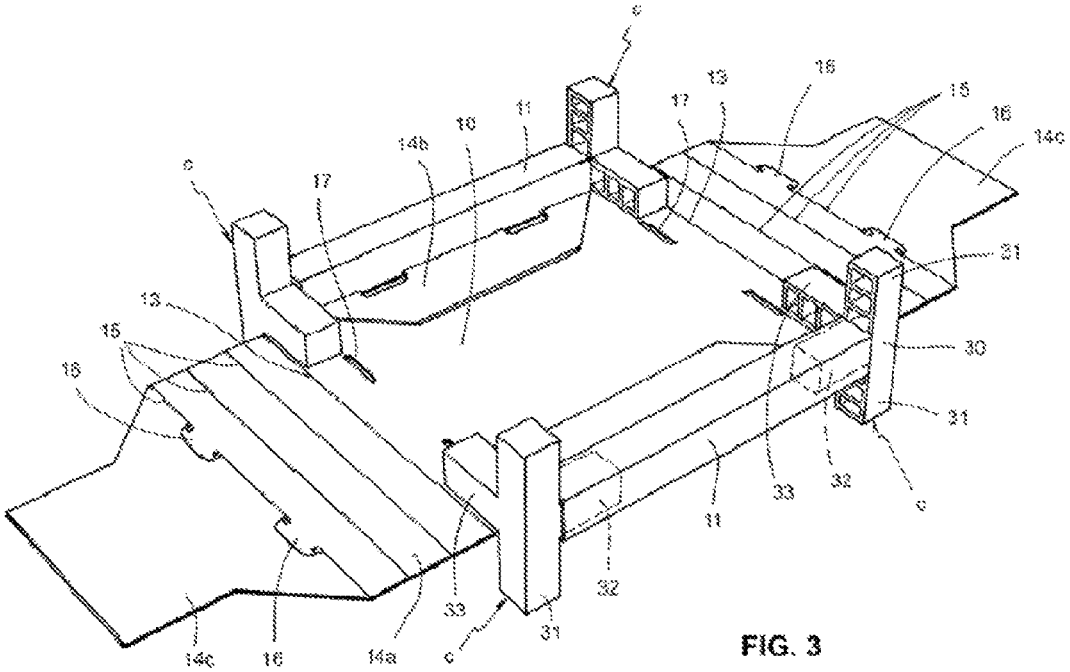
FIG. 3 is a perspective view which shows the partially folded sheet built with four connecting elements.
Figure 4:
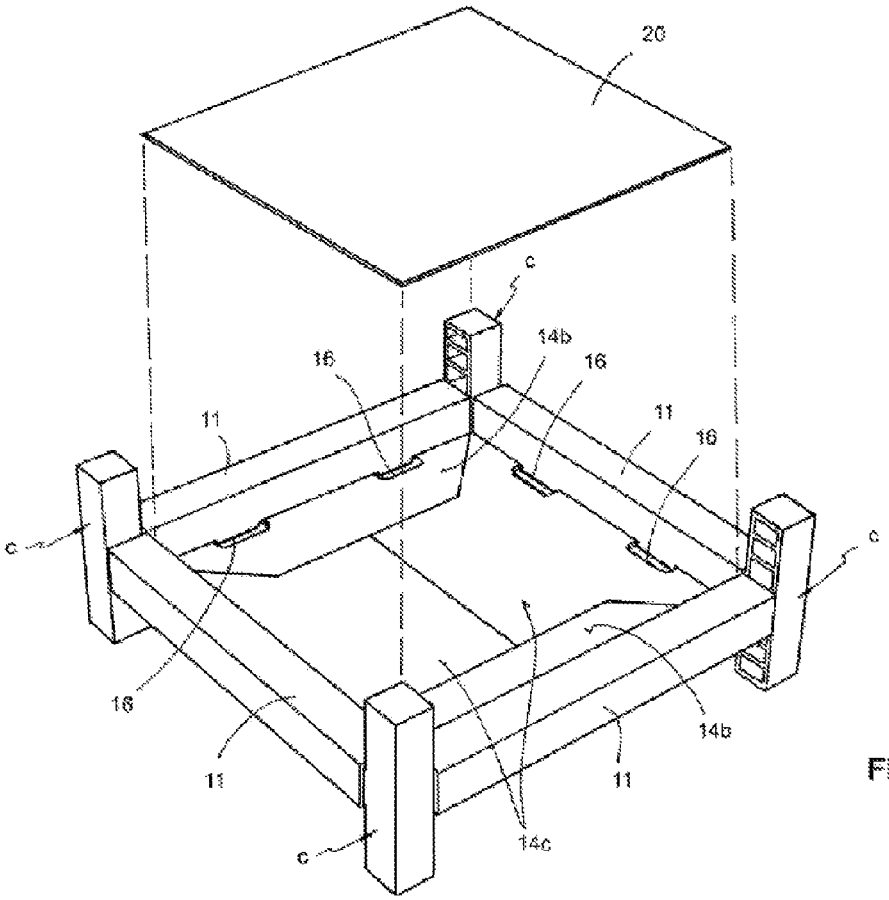
FIG. 4 is a perspective view of such shelf in position, built with the connecting elements, showing the projection of an accessory sheet to form a cover of the shelf supporting wall.

In order to assemble each shelf module (a), the first portions (14*a*) of two opposite flaps in the sheet are successively folded, fitting the flaps (16) into the respective slots (17) to form two opposite sections of the tubular edges (11). At the end of these two tubular edges (11), the corresponding arms (32) of four hubs (c) are inserted, as shown in FIG. 3. Then, the first sections (14*a*) of the two opposite flaps are folded and fixed in the same way, involving the opposite arms (33) of the hubs (c), being inserted into the ends of these new tubular edges (11) as it is shown in FIG. 4).

Shelf modules (a) built this way are linked to a tower shape by means of stud tubes (b), fitting the ends of such tubes in the arms (31) of the corner hubs (c)

The invention claimed is:

1. A formable sheet for forming a modular structure for a cardboard tower-like display, said structure formed of horizontally separated double-walled shelves and corner columns and when formed into said structure providing vertical support by being a support structure with said columns contactable with a floor and supporting said structure including shelves, comprising:

shelf modules having a four-sided central area, wherein corners form incoming vertexes and sides include fold lines linked to respective flaps, said flaps having first sections with consecutive parallel fold lines which includes capability of forming projected tubular edges and second sections each usable to form a wall with a surface equal to a central part of the sheet, each flap having reciprocal anchoring elements with said central part of the sheet;

straight tubes comprising stud modules for forming a part of each column with the same cross-section as said tubular edges; and hub-shaped connecting elements, each comprising a central part with arms, each projected into three spatial orthogonal directions to fit an end of said tubular edges and an end of a tube, wherein said formable sheet is transportable in sheet form so as to facilitate transport.

2. The formable sheet for forming a modular structure for a cardboard tower-like display, pursuant to claim 1, further comprising in each shelf module, the second sections of two opposite flaps being trapezoidal when structured and the second sections of two other opposite flaps being trapezoidal when structured said four second sections together formable in a quadrilateral.

3. The formable sheet for forming a modular structure for a cardboard tower-like display, pursuant to claim 1, further comprising anchoring elements with rectangular flaps and a pair of retention protrusions on the side said anchoring elements being constructable from respective "U" shaped dies which coincide with fold lines between said first and second sections in each flap and with straight slots corresponding to each flap, wherein each slot is the same length as each flap and where said slots.

4. The formable sheet for forming a modular structure for a cardboard tower-like display, pursuant to claim 1, further comprising said edges tubes featuring a square cross section and congruent with an arm of a connecting piece.

5. The formable sheet for forming a modular structure for a cardboard tower-like display, pursuant to claim 1, further comprising each tube from each corner column having a gapped end, where the height of the gap is equal to the height of the central area of the corresponding connecting element.

6. The formable sheet for forming a modular structure for a cardboard tower-like display, pursuant to claim 1, further comprising each connecting element being shaped as a corner hub comprising a central part with three orthogonal arms within a same virtual plane in a letter "T" shape and a fourth arm which features a perpendicular axis to said virtual plane, with one of the ends having reciprocal fixation means to said central part.

* * * * *